United States Patent [19]

Castle et al.

[11] Patent Number: 4,967,532

[45] Date of Patent: Nov. 6, 1990

[54] MEANS FOR AND METHOD OF MAKING A CAST STRUCTURAL FIRE PROOF PANEL ASSEMBLY

[75] Inventors: George K. Castle, Baton Rouge, La.; Edward C. Kash, Sugar Land, Tex.

[73] Assignee: Avco Corporation, Providence, R.I.

[21] Appl. No.: 492,394

[22] Filed: Mar. 7, 1990

Related U.S. Application Data

[63] Continuation of Ser. No. 270,695, Nov. 14, 1988, abandoned.

[51] Int. Cl.[5] ..... E04C 2/34; E04B 101/00

[52] U.S. Cl. ..... 52/599; 52/598; 52/802; 29/33 C; 249/189

[58] Field of Search ..... 29/33 C, 243.5, 458, 29/527.1; 52/800, 802, 805, 808, 810, 98, 598, 599; 109/84; 249/18, 33, 40, 47, 105, 189, 192, 193

[56] References Cited

U.S. PATENT DOCUMENTS

| | | | |
|---|---|---|---|
| 1,015,212 | 1/1912 | Schaffert | 52/805 X |
| 2,338,520 | 1/1944 | Labaree et al. | 52/805 X |
| 3,070,186 | 12/1962 | Meek | 52/800 X |
| 3,238,677 | 3/1966 | Soubier | 52/98 |
| 3,446,692 | 5/1969 | Turnbull | 52/800 X |
| 3,455,078 | 7/1969 | Brown et al. | 52/802 |
| 3,472,728 | 10/1969 | Hitch | 52/800 X |
| 3,759,009 | 9/1973 | Ransome | 52/599 X |
| 3,981,102 | 9/1976 | Hardwood et al. | 52/802 X |
| 4,399,972 | 8/1983 | McCulloch | 52/802 X |
| 4,593,449 | 6/1986 | Meray-Hovarth et al. | 29/527.1 |
| 4,643,933 | 2/1987 | Picken | 52/800 X |

FOREIGN PATENT DOCUMENTS

| | | | |
|---|---|---|---|
| 1232869 | 1/1967 | Fed. Rep. of Germany | 52/598 |
| 2706598 | 8/1978 | Fed. Rep. of Germany | 52/810 |
| 297841 | 10/1965 | Netherlands | 52/599 |

*Primary Examiner*—Timothy V. Eley
*Assistant Examiner*—Peter Dungba Vo
*Attorney, Agent, or Firm*—Abraham Ogman

[57] ABSTRACT

The invention relates to means and method of making a multiple castable structural panel in a single pouring operation. A mold-envelope constructed from a plurality of pieces is provided. The mold-envelope is constructed without any external fastening means. The poured core holds the pieces of the mold-envelope together.

3 Claims, 3 Drawing Sheets

MEANS FOR AND METHOD OF MAKING A CAST STRUCTURAL FIRE PROOF PANEL ASSEMBLY

This application is a continuation of 07/270,695 filed 11/14/1988 now abandoned.

BACKGROUND OF THE INVENTION

The invention is specifically directed to a means for and a method of making a one step castable structural composite panel assembly with internal fastening only. No external fastening means is used. In addition no bonding is required to hold the assembly together.

Generically the composite panel assembly which is the subject of the invention comprises a non-combustible core the surfaces of which are covered with thin metal sheets, sometimes called laminate or cladding. The cladding is formed into an envelope which contains the core. There exists in the prior art a host of such composite panels comprising clad cores. A brief description of a representative sampling of prior art patents follows.

The Crump U.S. Pat. No. 146,047 disclosed the use of spacers of many configurations to separate the walls of safes. External fasteners are used to hold sections together.

Oldberg in U.S. Pat. No. 1,159,411 describes a composite door which is held together by a series of external fasteners and interlocked or engaged internal clips.

In B. Labaree et al U.S. Pat. No. 2,338,520 a core may be poured around a series of stand-offs which serve as spacers also. The assembly is completed by running external fasteners through the mating panel and into the standoffs and edges of the poured piece. The external fasteners bind the two sides together.

Soubier U.S. Pat. No. 3,238,677 and Meray-Horvath U.S. Pat. No. 4,593,449 also illustrate composite panel structures.

Composite fireproof panels have a number of important uses. They are used in fire doors, cable trays, partitions, fire walls and the like. A commercially viable composite panel needs to be light in weight, structurally sound and competitive. The latter quality is extremely important since alternative structures including non-composite structures abound.

OBJECTS OF THE INVENTION

It is an object of the invention to provide a non-combustible composite panel which avoids the limitations and disadvantages of prior such devices.

It is another object of the invention to provide a mold-envelope for a non-combustible composite structural panel.

It is another object of the invention to provide a method of making a non-combustible composite panel which does not rely on external fasteners or bonding to hold it together.

It is yet another object of the invention to provide a method of making composite non-combustible panels where a plurality of mold-envelopes may be filled in a single pouring operation in immediate succession i.e. gang molded.

STATEMENT OF THE INVENTION

In accordance with the invention an integral mold-envelope for a composite non-combustible panel comprises a pair of spaced opposing sheets having peripheral edges and opposing faces separated by a space. In addition each of the interior faces of the opposing sheets includes spaced apart lateral spacers bridging the space. Each lateral spacer is in contact with each of the opposing faces. The lateral spacers are secured to one of the faces. Edge channel members are fitted over a substantial portion of the peripheral edges. The center of the channel encloses the space between the opposing faces whereby an access hole into the space between the opposing faces is provided.

Additionally there is described a method for forming composite non-combustible panels which comprises stacking a plurality of molds side by side with access hole on top and gang pouring non-combustible material into the envelopes in immediate succession in a single pouring operation. Another edge member is applied over the access hole before the non-combustible materials sets and hardens completing the panel.

BRIEF DESCRIPTION OF THE FIGURES

The novel features that are considered characteristic of the invention itself, however, both as to its organization and method of operation, together with additional objects and advantages thereof, will best be understood from the following description of a specific embodiment, when read in conjunction with the accompanying drawings, in which.

BRIEF DESCRIPTION OF THE INVENTION

The invention is directed to mold-envelopes for non combustible panels which are assembled without external fasteners and which can be filled in immediate succession. That is to say they can be gang filled in one pouring operation.

Figure 1:
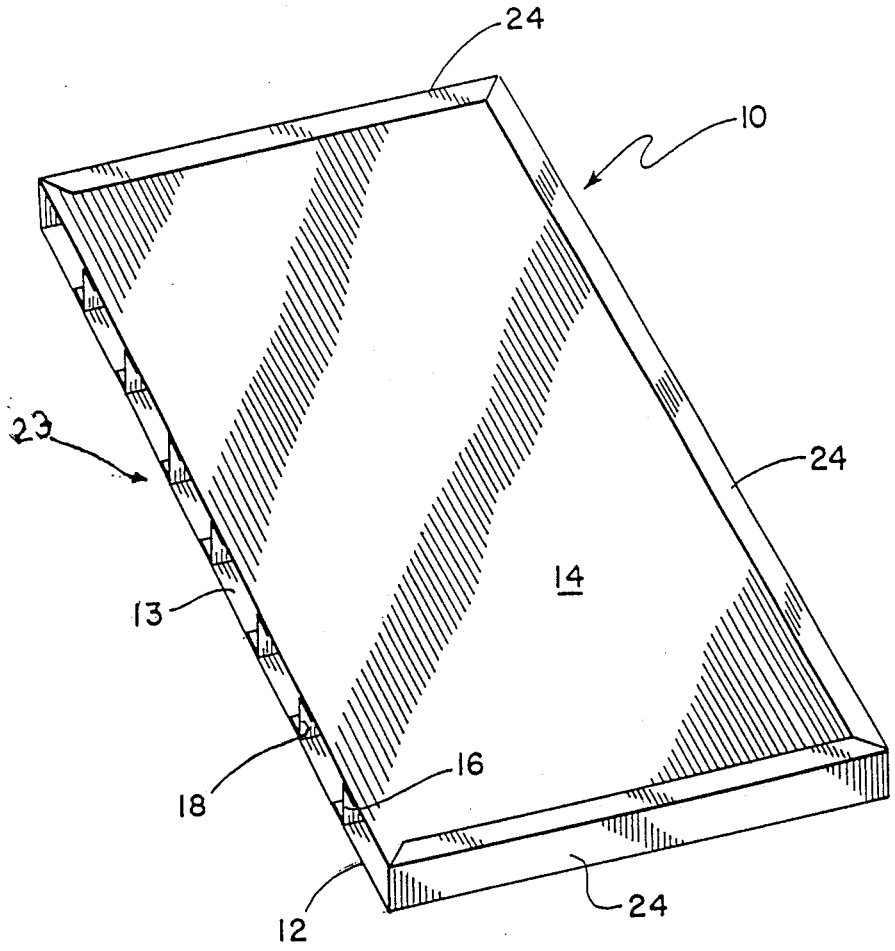
FIG. 1 depicts a mold-envelope with access hole constructed in in accordance with the invention.
Figure 2:
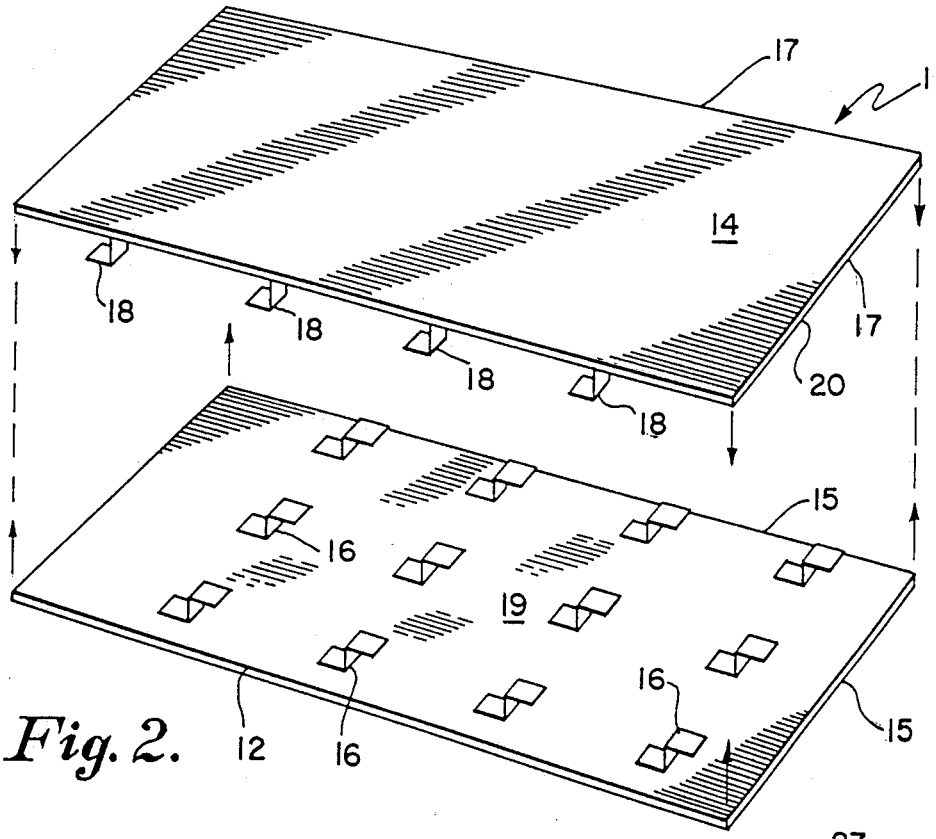
FIG. 2 is an exploded view of cladding sheets with lateral spacers attached.

Referring to FIG. 1 there is shown an assembled mold-envelope 10 for a composite non-combustible panel constructed in accordance with the invention. The mold-envelope 10 comprises a pair of spaced opposing sheets 12 and 14 separated by a space 13. The sheets are preferably metal such as stainless steel. The sheets 12 and 14 have peripheral edges 15 and 17 respectively. See FIG. 2. Each of the sheets 12 and 14 include interior faces 19 and 20. Interior face 19 includes a plurality of spaced lateral spacers 16 secured to the face as by spot welding. Similarly, interior face 20 includes lateral spacers 18.

Figure 3:
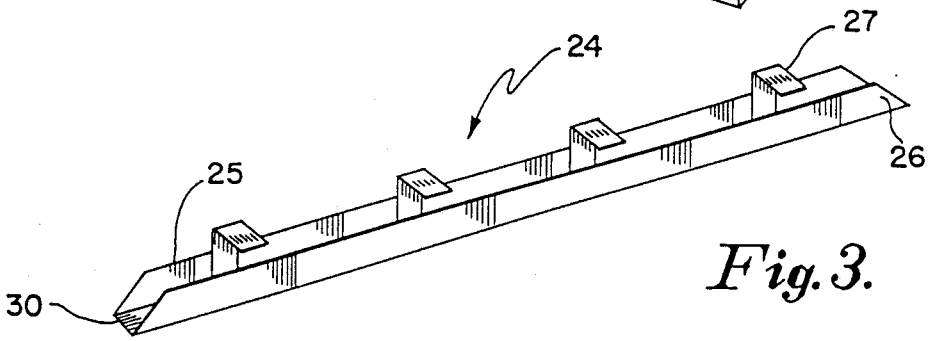
FIG. 3 depicts an edge member.

Referring to FIG. 3 there is shown the construction of an edge member 24 a channel member. The channel member 24 is defined by a center section 30 from which depends a pair of spaced legs 25 and 26. There is attached to the center section 30 lateral members 27.

The lateral spacers 16 and 18 are of the same length and are spaced so that they will not interfere with one another when the sheets 12 and 14 are brought together as shown in FIG. 1. The length of the lateral spacers 16 and 18 define the width of the space 13 when the sheets 12 and 14 are brought together.

The separation between legs 25 and 26 of the edge member 24 is configured to fit over the peripheral edges 15 and 17 when the sheets 12 and 14 are brought together.

In FIG. 1 three edge members 24 are fitted over the peripheral edged of sheets 12 and 14 to form a mold-envelope 10. In the process the access hole 23 is formed.

Figure 4:
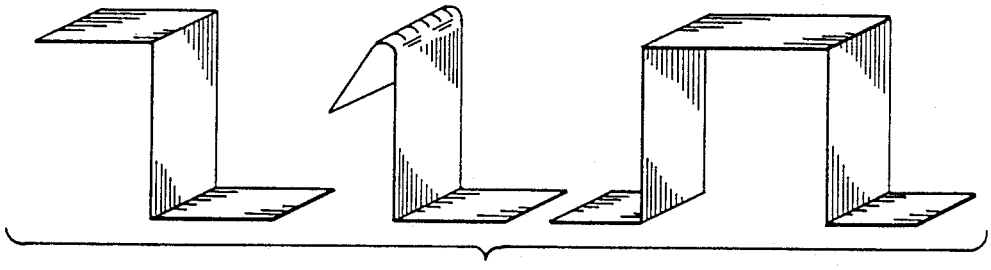
FIG. 4 shows several configurations of lateral supports.

In FIG. 4 there is illustrated three different configurations that the lateral supports 16 or 18 can take. The particular configuration is not critical and is selected for strength or interaction with the non-combustible core.

Figure 5:
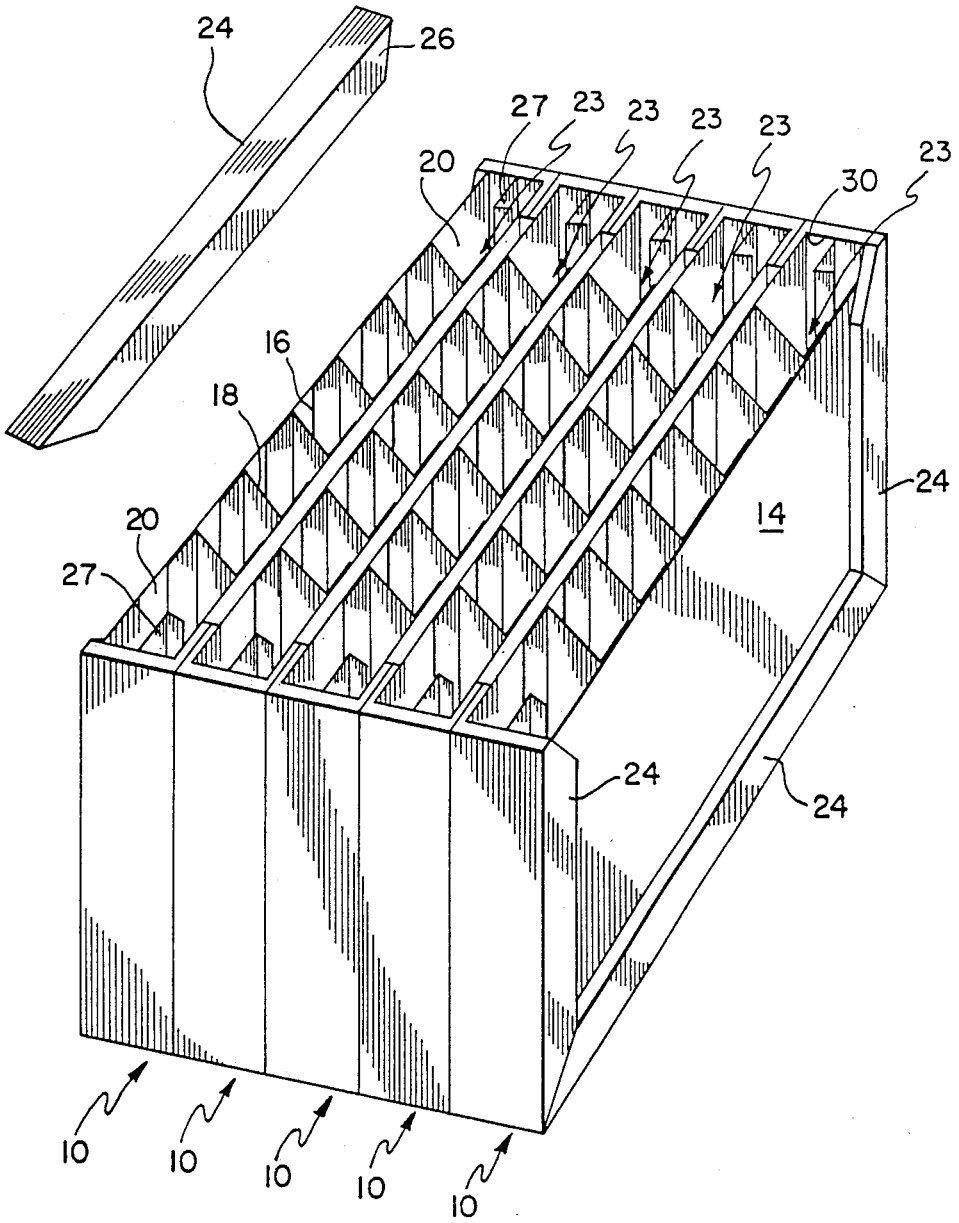
FIG. 5 is an illustration of a plurality of mold-envelopes ready to be filled.

In FIG. 5 there is depicted a plurality of mold-envelopes 10 arranged in a side by side relationship with their respective access holes 23 on top. To construct the composite non-combustible panels the core material is poured into each of the mold-envelopes in a single pouring operation in immediate succession. A lightweight cenentitious material is the preferred core material After all of the molds are filled the fourth edge member, illustrated by the single edge member 24 in FIG. 5 is placed over the access hole 23. The lateral supports 27 on this edge member penetrates into the recently poured core.

The following is claimed:

1. An integral mold and facing of a castable sandwich fireproof panel comprising:

a pair of spaced parallel opposing sheets having peripheral edges and opposing interior faces, said opposing interior faces are separated by a plurality of spaced apart first lateral members and said first lateral members defining a space which is between said opposing interior faces of said parallel opposing sheets, said spaced apart first lateral members being distributed over at least one of said interior opposing faces, said first lateral members being fastened to said one of the interior opposing faces and bridging said space to contact directly on said other interior opposing face, and edge channel members fitted over a substantial portion of the peripheral edges and each of said edge channel members having an interior face covering a substantial portion of the space between the opposing faces at said peripheral edges, and a plurality of second lateral members being provided on said interior face of said edge channel member, thus an access hole of said integral mold is formed by a portion of said peripheral edges being uncovered by said edge channel members for receiving castable material through said peripheral edges into said spaces between said opposing interior faces.

2. The integral mold and facing as defined in claim 1 wherein the edge channel members are U shaped members comprising a center portion defining said interior face and a pair of opposing depending portions, said second lateral members being fastened to said interior face and extending into said space.

3. The integral mold and facing as defined in claim 1 wherein said second lateral members are distributed over the other of the opposing interior faces bridging the space so as to contact the one opposing interior face, said first and second lateral members being secured to said one and the other of said opposing interior faces respectively, said second lateral members being spaced from said first lateral members on said opposing interior faces so as not to interfere with one another.

* * * * *